US011780256B2

(12) United States Patent
Yumiza

(10) Patent No.: US 11,780,256 B2
(45) Date of Patent: Oct. 10, 2023

(54) ASSEMBLY AND HOLDER

(71) Applicant: 3M INNOVATIVE PROPERTIES COMPANY, St. Paul, MN (US)

(72) Inventor: Kyoko Yumiza, Tokyo (JP)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 29 days.

(21) Appl. No.: 17/439,844

(22) PCT Filed: Mar. 18, 2020

(86) PCT No.: PCT/IB2020/052477
§ 371 (c)(1),
(2) Date: Sep. 16, 2021

(87) PCT Pub. No.: WO2020/194134
PCT Pub. Date: Oct. 1, 2020

(65) Prior Publication Data

US 2022/0184989 A1 Jun. 16, 2022

(30) Foreign Application Priority Data

Mar. 22, 2019 (JP) ..... 2019-055306

(51) Int. Cl.
*B42D 5/00* (2006.01)
*B42D 9/00* (2006.01)

(52) U.S. Cl.
CPC ..... *B42D 5/005* (2013.01); *B42D 9/004* (2013.01)

(58) Field of Classification Search
CPC ..... B42D 5/005; B42D 9/004; B42D 5/003; B42D 5/00; B42D 9/00
USPC ..... 40/726; 281/3.1, 15.1, 38, 45; 283/63.1; 221/33, 34
See application file for complete search history.

(56) References Cited

U.S. PATENT DOCUMENTS 5,397,117 A * 3/1995 Mertens ..... B42D 5/005 221/33
2003/0168468 A1 9/2003 Thompson
(Continued)

FOREIGN PATENT DOCUMENTS

JP 2003-072262 3/2003
JP 2006188031 7/2006
JP 3179690 U 11/2012
(Continued)

OTHER PUBLICATIONS

International Search report for PCT International Application No. PCT/IB2020/052477 dated Jun. 15, 2020, 5 pages.

*Primary Examiner* — Justin V Lewis
(74) *Attorney, Agent, or Firm* — Vincent Pham

(57) ABSTRACT

An assembly (1) includes a laminate (2) in which tags (21) are laminated, and a support part (3) that supports the laminate (2). The support (part 3) includes a bottom surface part (31) and a folding back part (32) folded back from the bottom surface part (31). A reverse surface (2*b*) of the laminate (2) protrudes from the folding back part (32), and a part of the reverse surface (2*b*) is adhered to the folding back part (32) to be supported by the support part (3). A laminate adhesive part (7) to which a part of the reverse surface (2*b*) and the support part (3) are adhered is disposed in an overlapping region AR1 of the reverse surface (2*b*) and the folding back part (32) so as to be separated from at least a part of a peripheral edge E of the overlapping region AR1.

11 Claims, 12 Drawing Sheets

(56) References Cited

U.S. PATENT DOCUMENTS

| | | | |
|---|---|---|---|
| 2009/0000972 | A1 | 1/2009 | Bartusiak |
| 2015/0007466 | A1 | 1/2015 | Van Wagoner |

FOREIGN PATENT DOCUMENTS

| | | |
|---|---|---|
| JP | 2017205924 | 11/2017 |
| JP | 3164409 | 9/2020 |

* cited by examiner

ASSEMBLY AND HOLDER

CROSS REFERENCE TO RELATED APPLICATIONS

This application is a national stage filing under 35 U.S.C. 371 of PCT/IB2020/052477, filed 18 Mar. 2020, which claims the benefit of Japanese Application No. 2019-055306, filed 22 Mar. 2019, the disclosures of which are incorporated by reference in their entireties herein.

TECHNICAL FIELD

One aspect of the present invention relates to an assembly including a laminate in which at least a plurality of tags are laminated, and a holder that holds the laminate of tags.

BACKGROUND ART

A tag slip that is attached to and carried with a notebook or the like is known (see Patent Document 1). This type of tag slip includes, for example, a mount inserted into a notebook or the like and a tag held in the mount. A plurality of tags are releasably laminated as a unit, and a reverse surface of the unit is adhered to and fixed to the mount.

CITATION LIST

Patent Documents

Patent Document 1: JP 2017-205924 A

SUMMARY OF INVENTION

Technical Problem

When moving and carrying a notebook or the like, the notebook or the like may, for example, bend when a load is applied from various directions. When a mount for a tag slip is attached to the notebook or the like, the load may be applied to the mount together with the notebook. As a result, in an aspect in which a plurality of tags are laminated and held, a "crack", in which part of the laminate of tags is peeled off from another part of the laminate of tags, or "peeling" as a stage before advancing to "cracking" may occur.

Solution to Problem

An assembly according to one aspect of the present invention includes a laminate in which at least a plurality of tags are laminated, and a support part that supports the laminate, wherein the plurality of tags are releasably adhered to each other, the support part includes a bottom surface part and a folding back part folded back from the bottom surface part, the laminate includes a surface on a first side and a reverse surface on a second side in a lamination direction of the tags, the reverse surface protruding from the folding back part and having a part being adhered to the folding back part to be supported by the support part, and a first adhesive part to which the part of the reverse surface and the support part are adhered is disposed in an overlapping region of the reverse surface and the folding back part so as to be separated from at least a part of a peripheral edge of the overlapping region.

Even when, for example, the load is applied to the assembly so as to bend the assembly, the load is absorbed by an opening, as a buffer, between the bottom surface part and the folding back part. Further, the reverse surface of the laminate protrudes from the folding back part, and substantially only a part of the laminate is supported by the folding back part. Therefore, even when the folding back part is bent by receiving the load, the bending is less likely to affect the laminate compared to an aspect in which the entire reverse surface of the laminate is supported. Further, the first adhesive part that adheres the folding back part and the laminate to each other is disposed in the overlapping region of the folding back part and the laminate so as to be separated from at least a part of the peripheral edge of the overlapping region. Further, in this separation region, a gap as a leeway is created between the folding back part and the laminate. This play absorbs the bending, and the laminate is less likely to be affected. As described above, in this assembly, the effect of the bending of a notebook or the like hardly appears in the laminate, and cracking or peeling hardly occurs in the laminate.

The folding back part of the assembly according to one aspect is folded back at a folding line with respect to the bottom surface part, and the first adhesive part may be disposed so as to be separated from a part, along the folding line, of the peripheral edge of the overlapping region in a direction orthogonal to the folding line. When a load is applied such that the assembly is bent to straddle the folding line, the bend can be absorbed by the gap in the separation region.

The folding back part of the assembly according to one aspect is folded back at a folding line with respect to the bottom surface part, and the first adhesive part may be disposed so as to be separated from the peripheral edge of the overlapping region in an extension direction of the folding line. When a load is applied such that the assembly is bent along the folding line, the bend can be absorbed by the gap in the separation region.

In the assembly according to one aspect, a maximum width of the first adhesive part from the peripheral edge of the overlapping region in a separation direction may be equal to or greater than a separation distance from the peripheral edge of the overlapping region. The absorption of the bend in the separation region and the maintenance of the adhesion at the first adhesive part can both be achieved.

An assembly according to one aspect of the present invention includes a laminate in which at least a plurality of tags are laminated, a support part that supports the laminate, and a fixing part that fixes the support part, wherein the plurality of tags are releasably adhered to each other, the support part includes a bottom surface part and a folding back part folded back from the bottom surface part, the laminate includes a surface on a first side and a reverse surface on a second side in a lamination direction of the tags, the reverse surface protruding from the folding back part and having a part being adhered to the folding back part to be supported by the support part, the support part is fixed to the fixing part by adhering, to the fixing part, a surface of the bottom surface part opposite to a surface facing the folding back part, and a second adhesive part to which the bottom surface part and the fixing part are adhered is disposed in an overlapping region of the reverse surface and the folding back part so as to be separated from at least a part of a peripheral edge of the overlapping region.

The second adhesive part of the assembly is disposed in the overlapping region of the bottom surface part and the fixing part so as to be separated from at least a part of the peripheral edge of the overlapping region. In this separation region, a gap as a leeway is formed between the bottom surface part and the fixing part. Here, for example, even when the load is applied to the assembly so as to bend the assembly, the bend is absorbed by the play and unlikely to affect the support part and the laminate. Further, the laminate is supported by being adhered to the folding back part folded back from the bottom surface part. When the fixing part is bent, the bend is therefore absorbed by an opening, as a buffer, between the bottom surface part and the folding back part. As described above, in this assembly, the effect of the bending of a notebook or the like hardly appears in the laminate, and cracking or peeling hardly occurs in the laminate.

The folding back part of the assembly according to one aspect is folded back at a folding line with respect to the bottom surface part, and the second adhesive part may be disposed so as to be separated from a part, along the folding line, of the peripheral edge of the overlapping region in a direction orthogonal to the folding line. When a load is applied such that the assembly is bent to straddle the folding line, the bend can be absorbed by the gap in the separation region.

The folding back part of the assembly according to one aspect is folded back at a folding line with respect to the bottom surface part, and the second adhesive part may be disposed so as to be separated from the peripheral edge of the overlapping region in the extension direction of the folding line. When a load is applied such that the assembly is bent along the folding line, the bend can be absorbed by the gap in the separation region.

In the assembly according to one aspect, a maximum width of the second adhesive part from the peripheral edge of the overlapping region in the separation direction may be greater than or equal to a separation distance from the peripheral edge of the overlapping region. The absorption of the bend in the separation region and the maintenance of the adhesion at the adhesive part can both be achieved.

In the assembly according to one aspect, the first adhesive part to which a part of the reverse surface and the support part are adhered may be disposed in an overlapping region between the reverse surface and the folding back part so as to be separated from at least a part of the peripheral edge of the overlapping region. Cracking of the laminate can be more effectively suppressed.

The folding back part of the assembly according to one aspect is folded back at a folding line with respect to the bottom surface part, the fixing part may include a third adhesive part on a surface opposite to a surface to which the bottom surface part is adhered, and the third adhesive part may be provided along the extension direction of the folding line. Even when a load is applied such that the assembly is bent along the folding line, the fixing part is stably held in place by the third adhesive part.

The folding back part of the assembly according to one aspect is folded back at a folding line with respect to the bottom surface part, the fixing part may include a third adhesive part on a surface opposite to a surface to which the bottom surface part is adhered, and the third adhesive part may be provided along a direction intersecting the folding line. When a load is applied such that the assembly is bent to straddle the folding line, the fixing part is stably held in place by the third adhesive part.

One aspect of the present invention is a holder for a laminate in which at least a plurality of tags are laminated, the holder including a support part that supports the laminate, and a fixing part that fixes the support part, wherein the support part includes a bottom surface part and a folding back part folded back from the bottom surface part, the folding back part being provided with a laminate support region. The support part is fixed to the fixing part by adhering the fixing part and a surface of the bottom surface part opposite to a surface facing the folding back part to each other. An adhesive part to which the bottom surface part and the fixing part are adhered is disposed in an overlapping region of the bottom surface part and the fixing part so as to be separated from at least a part of a peripheral edge of the overlapping region. In this holder, cracking and peeling of the laminate can be effectively suppressed.

Advantageous Effects of Invention

According to one aspect of the present invention, cracking of a laminate in which a plurality of tags are laminated can be suppressed.

BRIEF DESCRIPTION OF DRAWINGS

FIGS. 9A and 9B are explanatory diagrams illustrating an assembly attached to an adherend such as a notebook or the like. FIG. 9A is an explanatory diagram illustrating the adherend closed. FIG. 9B is an explanatory diagram illustrating the adherend open.

FIG. 10A is a cross-sectional view illustrating an embodiment. FIG. 10B is a cross-sectional view illustrating a comparative embodiment.

FIG. 12A is a diagram describing an experiment in which the assembly is bent in a lateral direction. FIG. 12B is a diagram describing an experiment in which the assembly is bent in a longitudinal direction.

DESCRIPTION OF EMBODIMENTS

The term "tag" herein includes a wide range of sheet-shaped members that are affixed to various adherends, such as paper products such as notebooks, books, and brochures, metals in personal computer desktops, cabinets, office furniture, office products, and OA equipment, wood or resin products, and interior materials. Further, the "tag" is not limited to a form in which note taking or the like is possible, and there is no limitation regarding a material or a design of the tag. Further, the "tag" may be a form that can be used simply as a mark or a form that can be used as a bookmark or the like.

The term "laminate" used herein is not limited to having a form in which only the tags are laminated, but may be other forms, such as a form in which a member other than the tag (e.g., a release paper) is laminated and attached to a position on a reverse surface that is a bottom surface, or a form in which a member other than the tag is interposed in an intermediate position.

Detailed descriptions of the embodiments according to the present invention are given below with reference to the attached drawings. Note that, in the description of the drawings, identical elements are denoted using the same reference signs, and duplicate descriptions thereof are omitted.

Figure 1:
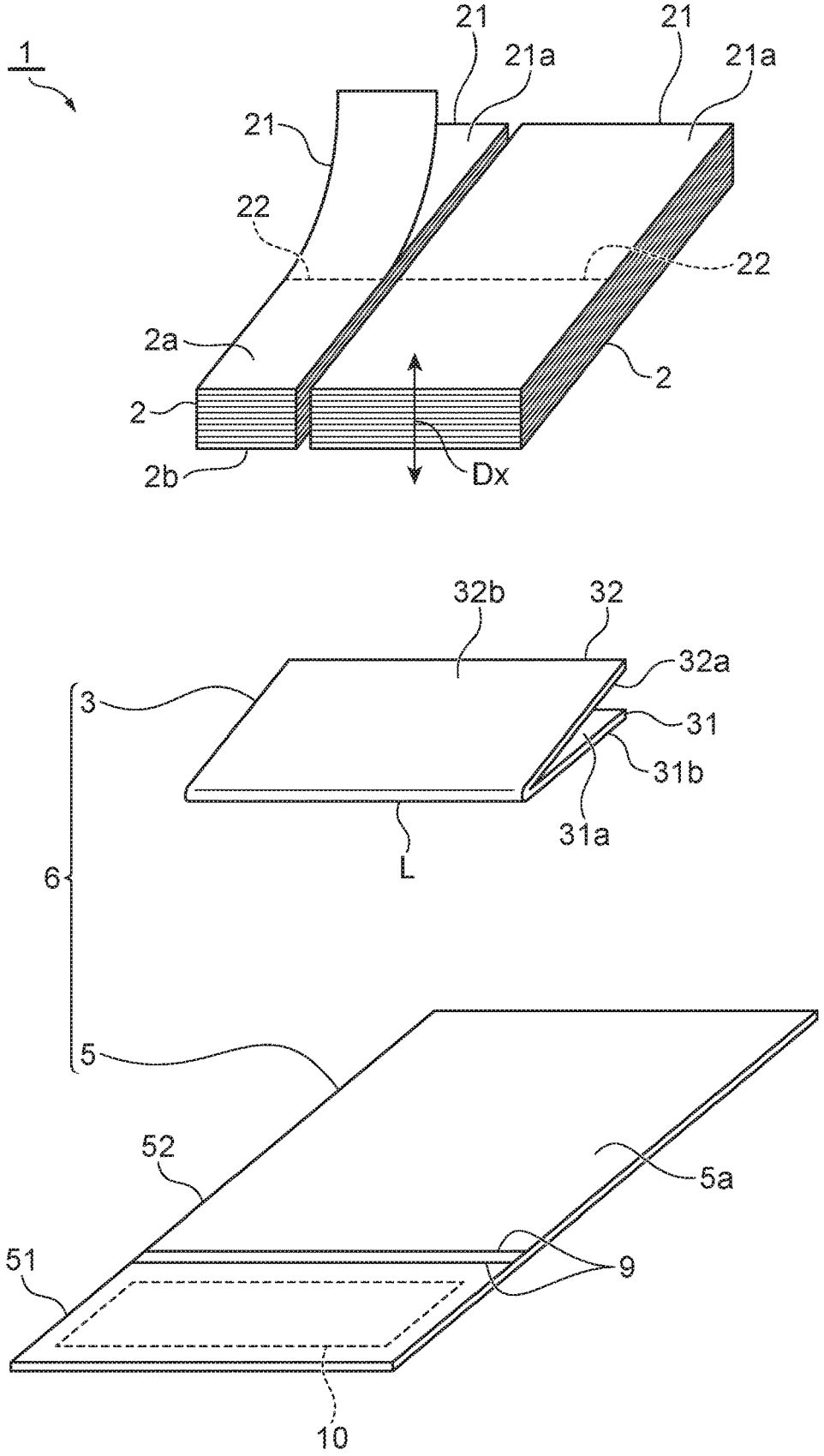
FIG. 1 is an exploded perspective view of an assembly according to one embodiment.
Figure 2:
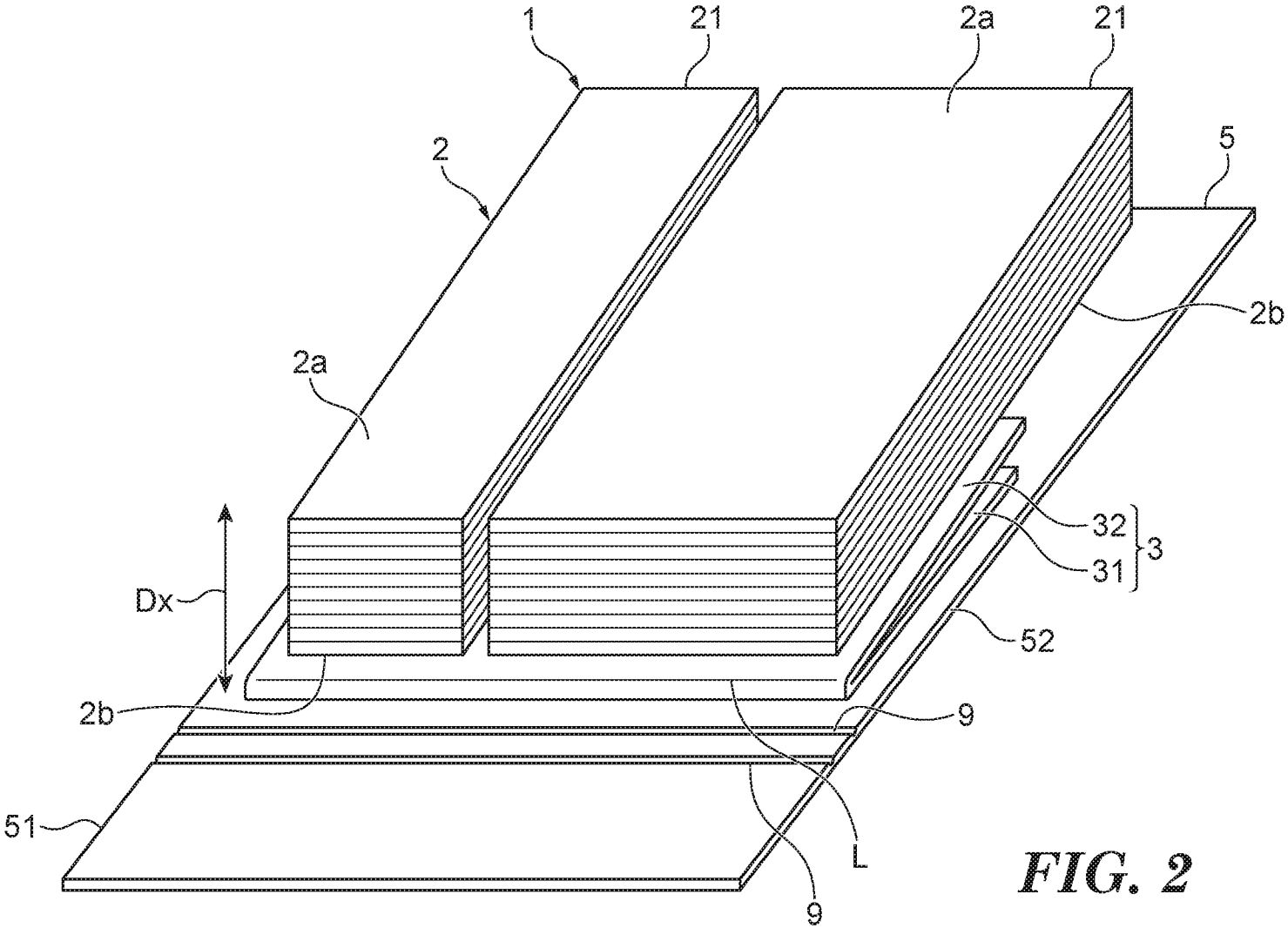
FIG. 2 is a perspective view of an assembly according to an embodiment.
Figure 3:
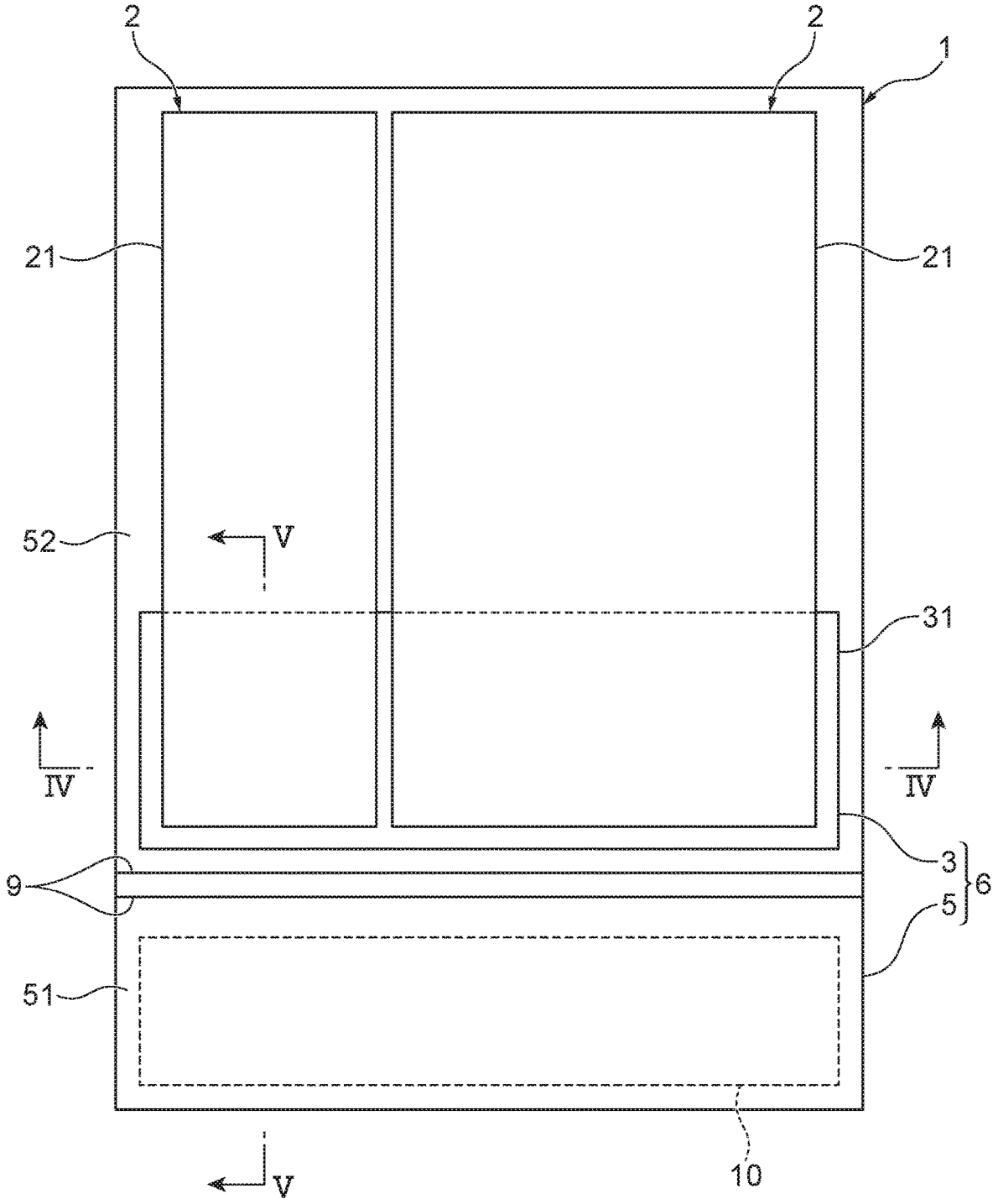
FIG. 3 is a plan view of an assembly according to an embodiment.
Figure 9A:
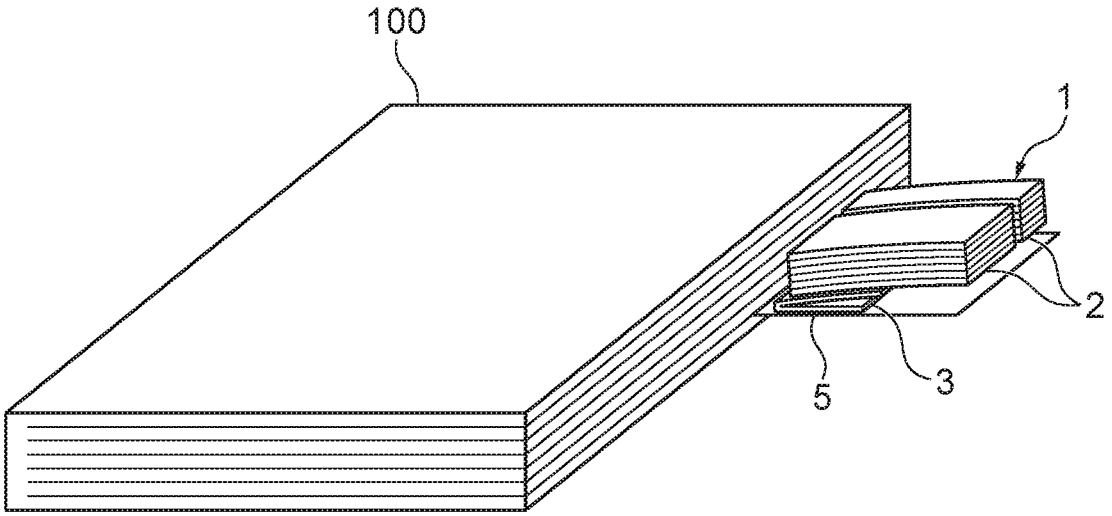
Figure 9B:
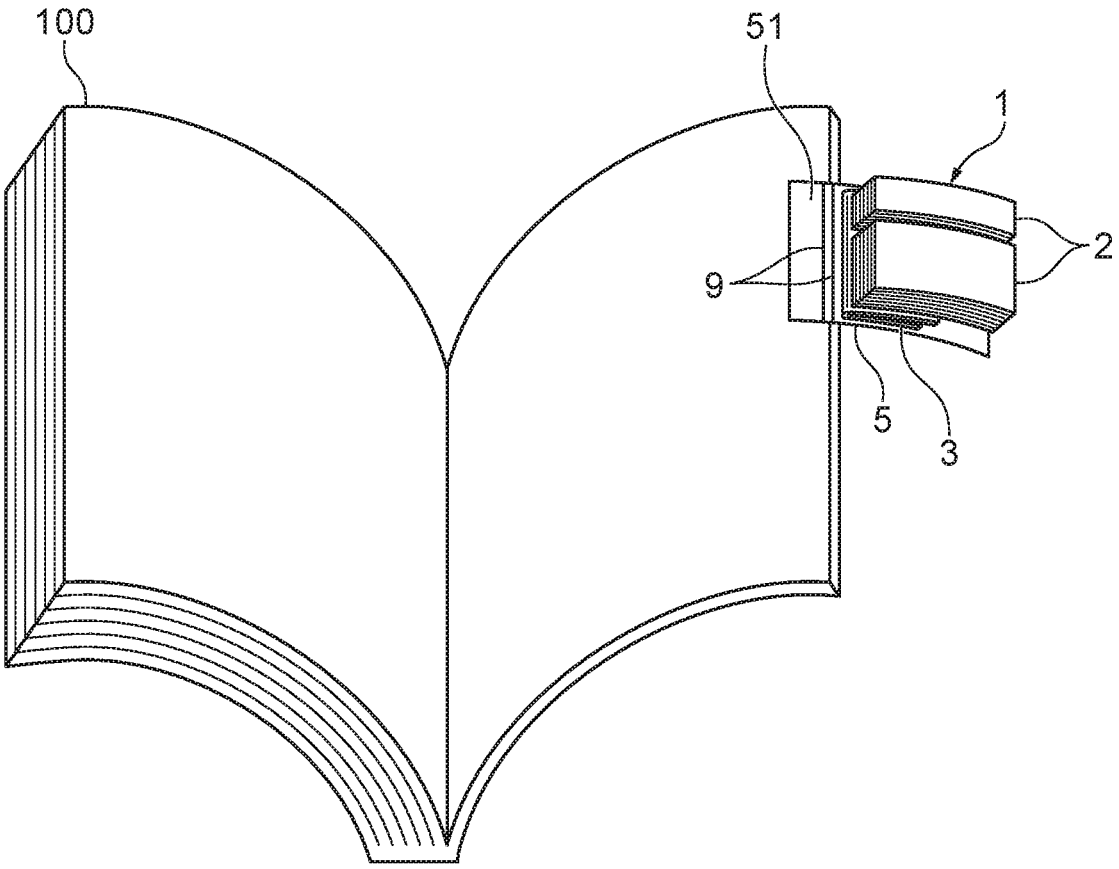

As illustrated in FIGS. 1, 2, and 3, an assembly 1 according to an embodiment includes at least a laminate 2 in which tags 21 are laminated, a support part 3 that supports the laminate 2, and a fixing part 5 that fixes the support part 3. Note that, although a configuration is described in which the fixing part 5 is provided in this embodiment, the fixing part 5 may be omitted from the assembly 1. In a configuration in which the fixing part 5 is omitted, for example, the assembly 1 may be used with the support part 3 directly attached to an adherend 100 (see FIGS. 9A and 9B).

The tag 21 may be made of paper, resin, or other materials as long as the tag 21 is a sheet-shaped member. The tag 21 may have a regular shape such as rectangular, square, circular, or oval shape, or an irregular shape. The tag 21 may also have a shape to remind a viewer of the shape of a particular character, animal, vehicle, or the like. Further, the plurality of tags 21 aligned in a lamination direction Dx may have an identical shape or different shapes.

The plurality of laminated tags 21 are releasably adhered to each other. Each of the tags 21 has a surface 21*a* and a reverse surface 21*b* (see FIG. 4), and an adhesive 22 is applied to a part of the reverse surface 21*b*. In order for a user of the tag 21 to easily peel off the tag 21, the adhesive 22 is disposed on a part that is offset from the center to one side rather than on the entire surface of the reverse surface 21*b* of the tag 21. For example, when the tag 21 is rectangular, the adhesive 22 is disposed offset to one side in a longitudinal direction. For example, a first tag 21 and a second tag 21 laminated on the surface 21*a* of the first tag 21 are assumed. In this case, a partial region of the surface 21*a* of the first tag 21 is affixed to the adhesive 22 disposed on the reverse surface 21*b* of the second tag 21. Further, after the second tag 21 is peeled off from the first tag 21, the adhesive 22 preferably does not remain on the surface 21*a* of the first tag 21.

For example, a water-dispersible adhesive can be used as the adhesive 22 to be applied to the tag 21.

The laminate 2 includes both end surfaces with respect to the lamination direction Dx of the plurality of tags 21. One end is a surface 2*a* of the laminate 2, and the other end is a reverse surface 2*b* of the laminate 2. More specifically, of both ends of the laminate 2, the end at which the surface 21*a* of the tag 21 appears is the surface 2*a* of the laminate 2, and the opposite end is the reverse surface 2*b* of the laminate 2. Note that members other than the tag 21 (release paper or the like) may be disposed on the opposite end of the laminate 2. In this case, the reverse surface 2*b* of the laminate 2 is formed by a member other than the tag 21.

The support part 3 may be made of paper, resin, or other materials. The support part 3 has a V-shape cross-section, and includes a bottom surface part 31 and a folding back part 32 folded back from the bottom surface part 31. The bottom surface part 31 and the folding back part 32 are connected via a straight folding line L. The folding line L represents a substantial boundary between the bottom surface part 31 and the folding back part 32. The folding back part 32 preferably has a constant elastic action with respect to the bottom surface part 31. Specifically, it is preferable that there is a slight gap in a facing direction between the folding back part 32 and the bottom surface part 31 in a stationary state, the gap is reduced under a load in the facing direction, and restored to the stationary state when released from the load.

Figure 4:
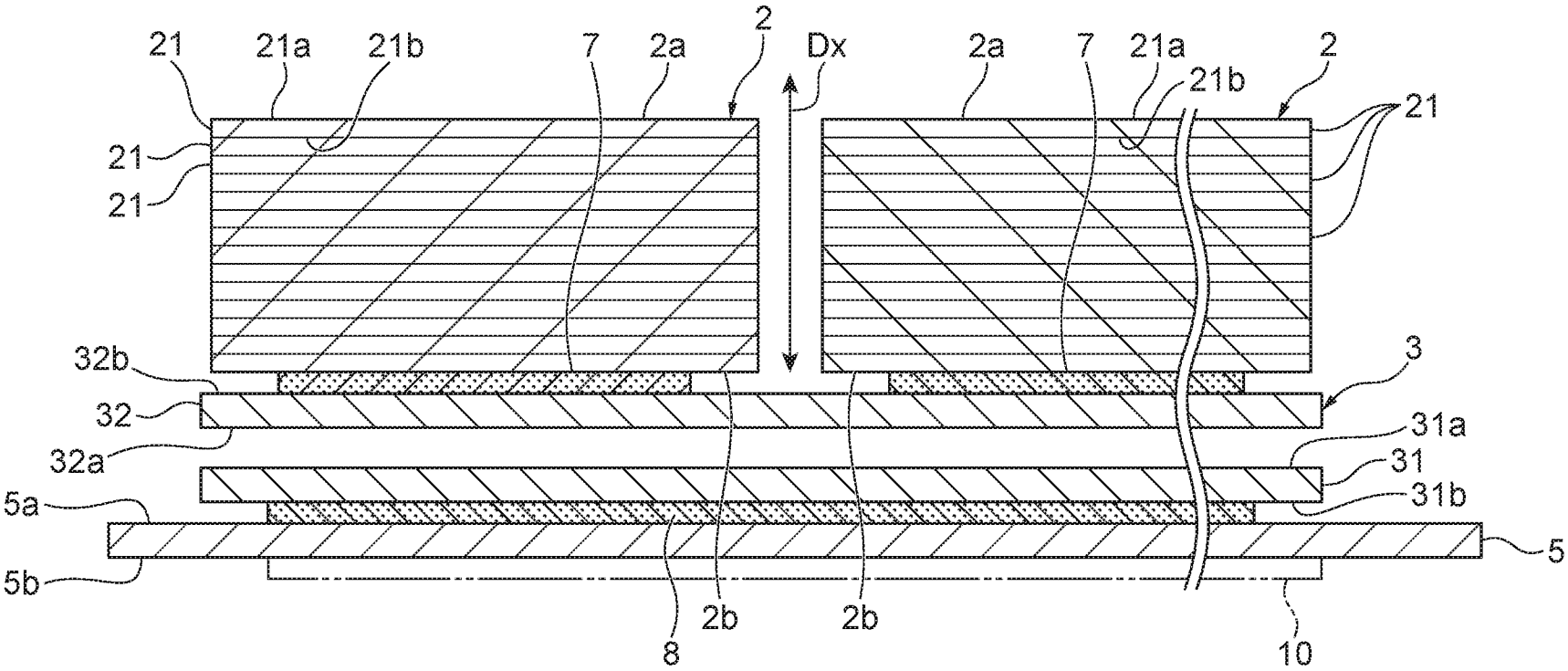
FIG. 4 is a cross-sectional view taken along line IV-IV in FIG. 3.
Figure 5:
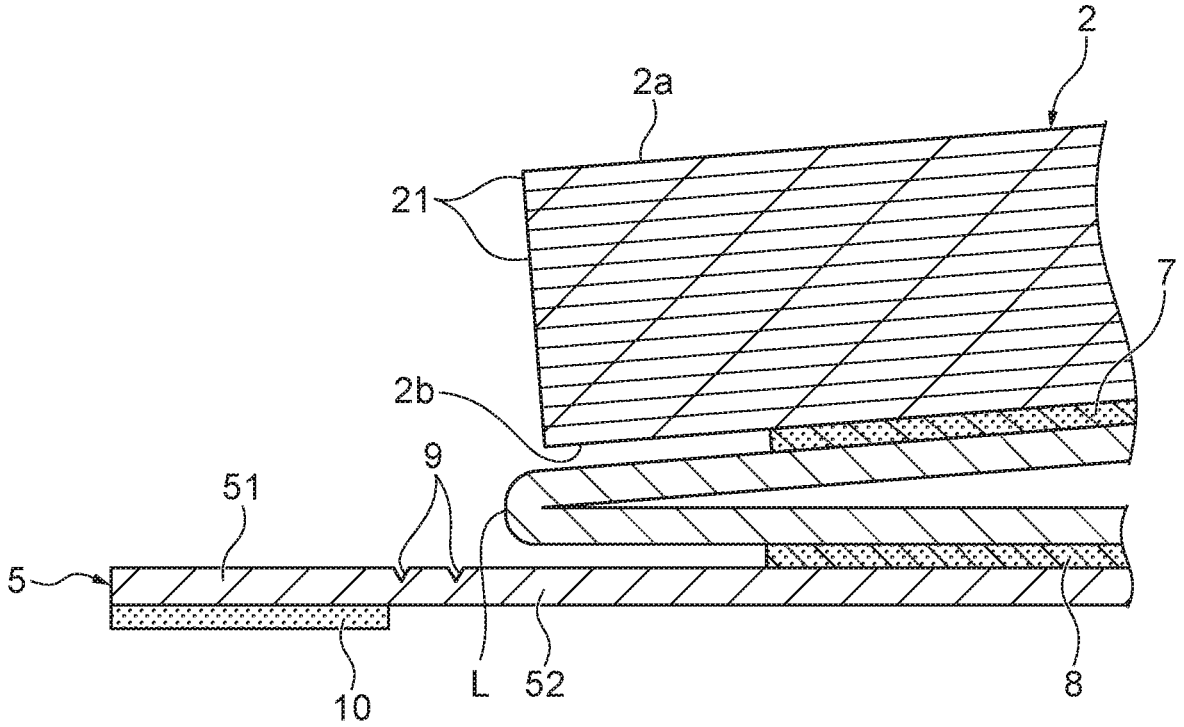
FIG. 5 is a cross-sectional view taken along line V-V in FIG. 3.

As illustrated in FIGS. 4 and 5, the folding back part 32 includes a surface facing the bottom surface part 31 (hereinafter, referred to as a "lower surface" for convenience) and an opposite surface of the lower surface (hereinafter, referred to as a "top surface" for convenience) 32*b*. The top surface 32*b* of the folding back part 32 is a laminate support region. A part of the reverse surface 2*b* of the laminate 2 is placed on the top surface 32*b* of the folding back part 32. As described in greater detail based on aspects illustrated in FIGS. 4 and 5, the laminate 2 is disposed such that a part of the reverse surface 2*b* on one end in the longitudinal direction is laminated on the folding back part 32, and the other end of the reverse surface 2*b* protrudes from the folding back part 32. In other words, the one end of the laminate 2 functions as a fixed end, and the other end of the laminate 2 functions as a free end.

An adhesive part 7 that adheres the folding back part 32 and the laminate 2 to each other is provided between the folding back part 32 and the reverse surface 2*b* of the laminate 2. This adhesive part 7 is referred to as a "laminate adhesive part" for convenience. The laminate adhesive part 7 is an example of a first adhesive part. For example, an acrylic, silicone, or rubber adhesive can be used as the laminate adhesive part 7. The laminate adhesive part 7 has an adhesive strength equal to or greater than an adhesive strength of the adhesive 22 that adheres the tags 21 to each other.

Figure 6:
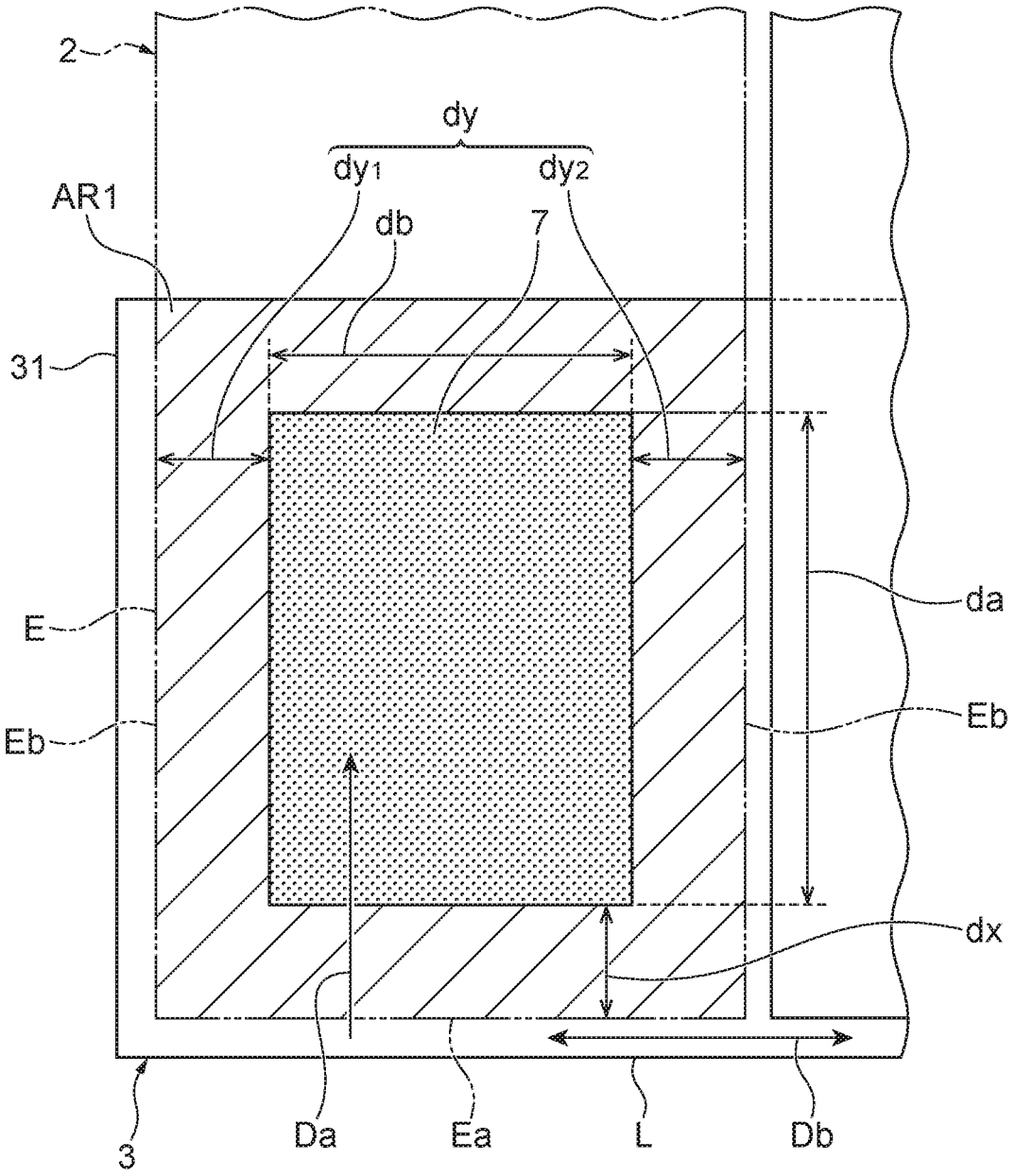
FIG. 6 is an enlarged virtual plan view illustrating a laminate adhesive part.

When the assembly 1 is viewed in plan view, a part where the folding back part 32 and the reverse surface 2*b* of the laminate 2 overlap each other is an overlapping region AR1 (see the hatched part in FIG. 6). The laminate adhesive part 7 (see dotted part in FIG. 6) is disposed in the overlapping region AR1 of the folding back part 32 and the laminate 2. The overlapping region AR1 is referred to as a "first overlapping region" for convenience of description. The laminate adhesive part 7 according to this embodiment is disposed so as to be separated from the entire peripheral edge E of the first overlapping region AR1.

More specifically, the laminate adhesive part 7 is disposed so as to be separated from at least a part Ea, along the folding line L, of the support part 3, of the peripheral edge E of the first overlapping region AR1. That is, the laminate adhesive part 7 is separated from the part Ea of the peripheral edge E of the first overlapping region AR1 in a direction orthogonal to the folding line L. This direction is a first separation direction Da. A maximum width da of the laminate adhesive part 7 in the first separation direction Da is equal to or greater than a distance (separation distance) dx from the peripheral edge E of the first overlapping region AR1 to the laminate adhesive part 7 in the first separation direction Da. Note that when the reverse surface 2*b* of the laminate 2 and the laminate adhesive part 7 do not have a rectangular shape or the like in a plan view, and have a bent outer shape or an outer shape such as an inflection, the closest distance between the part Ea of the peripheral edge E and the laminate adhesive part 7 is the separation distance dx.

The separation distance dx from the peripheral edge E of the first overlapping region AR1 to the laminate adhesive part 7 is, for example, 2 mm or greater and can be 30 mm or less. The separation distance dx is 5 mm or greater and can be 20 mm or less. A maximum width de is 5 mm or greater and can be 30 mm or less. The maximum width de is 10 mm or greater and can be 20 mm or less.

The peripheral edge E of the first overlapping region AR1 includes side parts Eb (parts) facing each other in an extension direction of the folding line L, and the laminate adhesive part 7 is disposed between both side parts Eb. The laminate adhesive part 7 according to this embodiment is separated from both of the side parts Eb of the first overlapping region AR1, rather than one of the side parts Eb. The extension direction of the folding line L is a second separation direction Db. A maximum width db of the laminate adhesive part 7 in the second separation direction Db is equal to or greater than the distance (separation distance) dy from the side parts Eb of the first overlapping region AR1 to the laminate adhesive part 7 in the second separation direction Db. The separation distance dy is determined by a sum of one distance $dy_1$ and another distance $dy_2$ illustrated in FIG. 6. Note that when the reverse surface 2*b* of the laminate 2 and the laminate adhesive part 7 do not have a rectangular shape or the like in a plan view, and have a bent outer shape or an outer shape such as an inflection, the closest distance between the side parts Eb of the peripheral edge E and the laminate adhesive part 7 is the separation distance dy.

The separation distance dy is, for example, 4 mm or greater and can be 30 mm or less. The separation distance dx is 8 mm or greater and can be 20 mm or less. The maximum width db is 5 mm or greater and can be 30 mm or less. The maximum width db is 10 mm or greater and can be 20 mm or less.

The folding back part 32 that supports the laminate 2 is longer than the bottom surface part 31 in the first separation direction Da. The folding back part 32 is longer than the bottom surface part 31, which is advantageous for stable support of the laminate 2. However, as described above, the reverse surface of the laminate 2 protrudes from the folding back part 32, and substantially only a part of the laminate 2 is supported by the folding back part 32.

The bottom surface part 31 of the support part 3 has a surface 31*a* facing the folding back part 32, and an opposite surface of the surface 31*a* (hereinafter, referred to as a "lower surface" for convenience) 31*b*. The lower surface 31*b* of the bottom surface part 31 is laminated on the fixing part 5.

The fixing part 5 is, for example, sheet-shaped, and includes a surface 5*a* facing the support part 3, and a reverse surface 5*b* opposite to the surface 5*a*. The fixing part 5 may be made of paper, resin, or other materials. The fixing part 5 includes an attachment part 51 that is attached to an adherend 100 (see FIG. 9) such as a notebook, and a base part 52 to which the support part 3 is fixed. The lower surface 31*b* of the bottom surface part 31 of the support part 3 is placed on a surface of the base part 52 (the surface 5*a* of the fixing part 5).

An adhesive part 8 that adheres the bottom surface part 31 and the fixing part 5 to each other is provided between the bottom surface part 31 and the fixing part 5 (for example, the base part 52). The adhesive part 8 is referred to as an "intermediate adhesive part" for convenience. The intermediate adhesive part 8 is an example of a second adhesive part. For example, an acrylic, silicone, or rubber adhesive can be used as the intermediate adhesive part 8. The intermediate adhesive part 8 has an adhesive strength equal to or greater than the adhesive strength of the adhesive 22 that adheres to each other.

Figure 7:
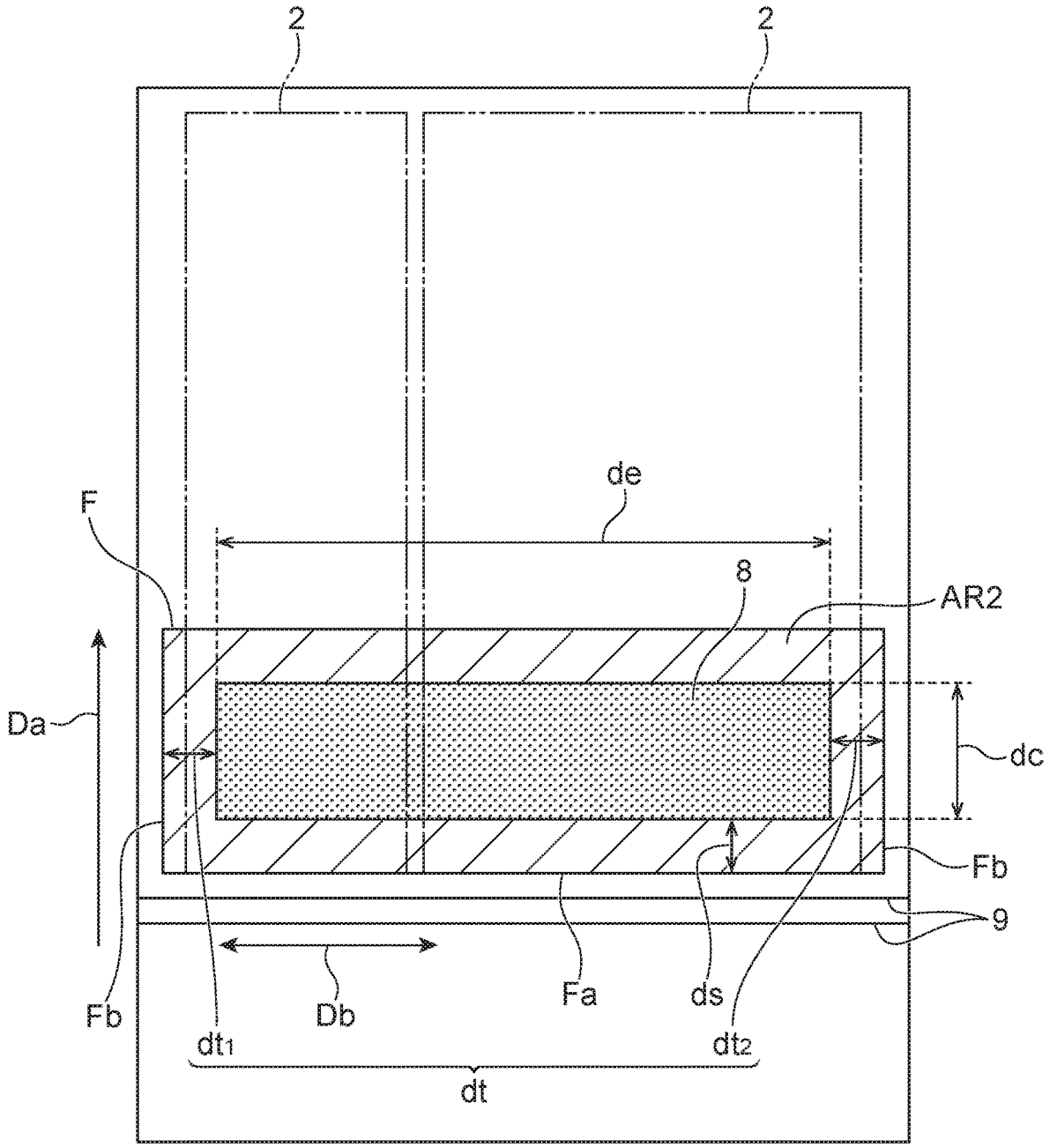
FIG. 7 is a virtual plan view illustrating an enlarged intermediate adhesive part.

When the assembly 1 is viewed in plan view, a part where the lower surface 31*b* of the bottom surface part 31 overlaps with the fixing part 5 is an overlapping region AR2 (see a hatched part in FIG. 7). The overlapping region AR2 is referred to as a "second overlapping region" for convenience of description. The intermediate adhesive part 8 (see a dotted part in FIG. 7) is disposed in the second overlapping region AR2. The intermediate adhesive part 8 according to this embodiment is disposed so as to be separated apart from the entire periphery of a peripheral edge F of the second overlapping region AR2.

More specifically, the intermediate adhesive part 8 is disposed so as to be separated from at least a part Fa, along the folding line L, of the support part 3, of the peripheral edge F of the second overlapping region AR2. That is, the intermediate adhesive part 8 is separated from the part Fa of the peripheral edge F of the second overlapping region AR2 in a direction orthogonal to the folding line L. This direction is the first separation direction Da, as described above. A maximum width dc of the intermediate adhesive part 8 in the first separation direction Da is greater than or equal to the distance (separation distance) ds from the peripheral edge F of the second overlapping region AR2 to the intermediate adhesive part 8 in the first separation direction Da. Note that when the bottom surface part 31 and the intermediate adhesive part 8 of the support part 3 do not have a rectangular shape in a plan view, and have a bent outer shape or an outer shape such as an inflection, the closest distance between the part Fa of the peripheral edge F and the intermediate adhesive part 8 is the separation distance ds.

The separation distance ds from the peripheral edge F of the second overlapping region AR2 to the intermediate adhesive part 8 is, for example, 2 mm or greater and can be 30 mm or less. The separation distance ds is 5 mm or greater and can be 20 mm or less. The maximum width dc is 5 mm or greater and can be 30 mm or less. The maximum width dc is 10 mm or greater and can be 20 mm or less.

In addition, the peripheral edge F of the second overlapping region AR2 includes the side parts Fb facing each other in the extension direction of the folding line L, and the intermediate adhesive part 8 is disposed between both side parts Fb. The intermediate adhesive part 8 according to this embodiment is separated from both of the side parts Fb of the second overlapping region AR2, rather than one of the side parts Fb. The extension direction of the folding line L is the second separation direction Db as described above. A maximum width de of the intermediate adhesive part 8 in the second separation direction Db is greater than or equal to the distance (separation distance) dt from the side part Fb of the second overlapping region AR2 in the second separation direction Db to the intermediate adhesive part 8. The separation distance dt is determined by a sum of one distance $dt_1$ and another distance $dt_2$ as illustrated in FIG. 7. Note that when the bottom surface part 31 of the support part 3 or the intermediate adhesive part 8 has a bent outer shape or an outer shape such as an inflection, rather than a rectangular shape or the like in a plan view, the closest distance between the side part Fb of the peripheral edge F and the intermediate adhesive part 8 is the separation distance dt.

The separation distance dt is, for example, 4 mm or greater and can be 30 mm or less. The separation distance dt is 8 mm or greater and can be 20 mm or less. The maximum width de is 5 mm or greater and can be 30 mm or less. The maximum width de is 10 mm or greater and can be 20 mm or less.

Two flexible rectilinear grooves 9 are formed in a boundary between the base part 52 and the attachment part 51 of the fixing part 5. The two grooves 9 are provided on the surface 5*a* of the fixing part 5 and are disposed substantially parallel to each other. For example, when the assembly 1 is attached to a notebook or the like, the assembly 1 can be carried while the assembly 1 is attached without protruding from the notebook or the like by bending the fixing part 5 inward at the grooves 9.

An adhesive part 10 is provided on the reverse surface 5*b* of the fixing part 5, that is, on the surface opposite to the surface to which the bottom surface part 31 is adhered. The adhesive part 10 is referred to as an "attachment adhesive part" for convenience of description. The attachment adhesive part 10 is an example of a "third adhesive part". For example, an acrylic, silicone, or rubber adhesive can be used as the attachment adhesive part 10. The attachment adhesive part 10 according to this embodiment is disposed on the reverse surface of the attachment part 51, and is provided along the extension direction of the folding line L of the support part 3. A release paper (not illustrated) may be affixed to the attachment adhesive part 10 to protect the adhesive surface. Further, the attachment adhesive part 10 may be releasably attached to the adherend such as a notebook.

Figure 8:
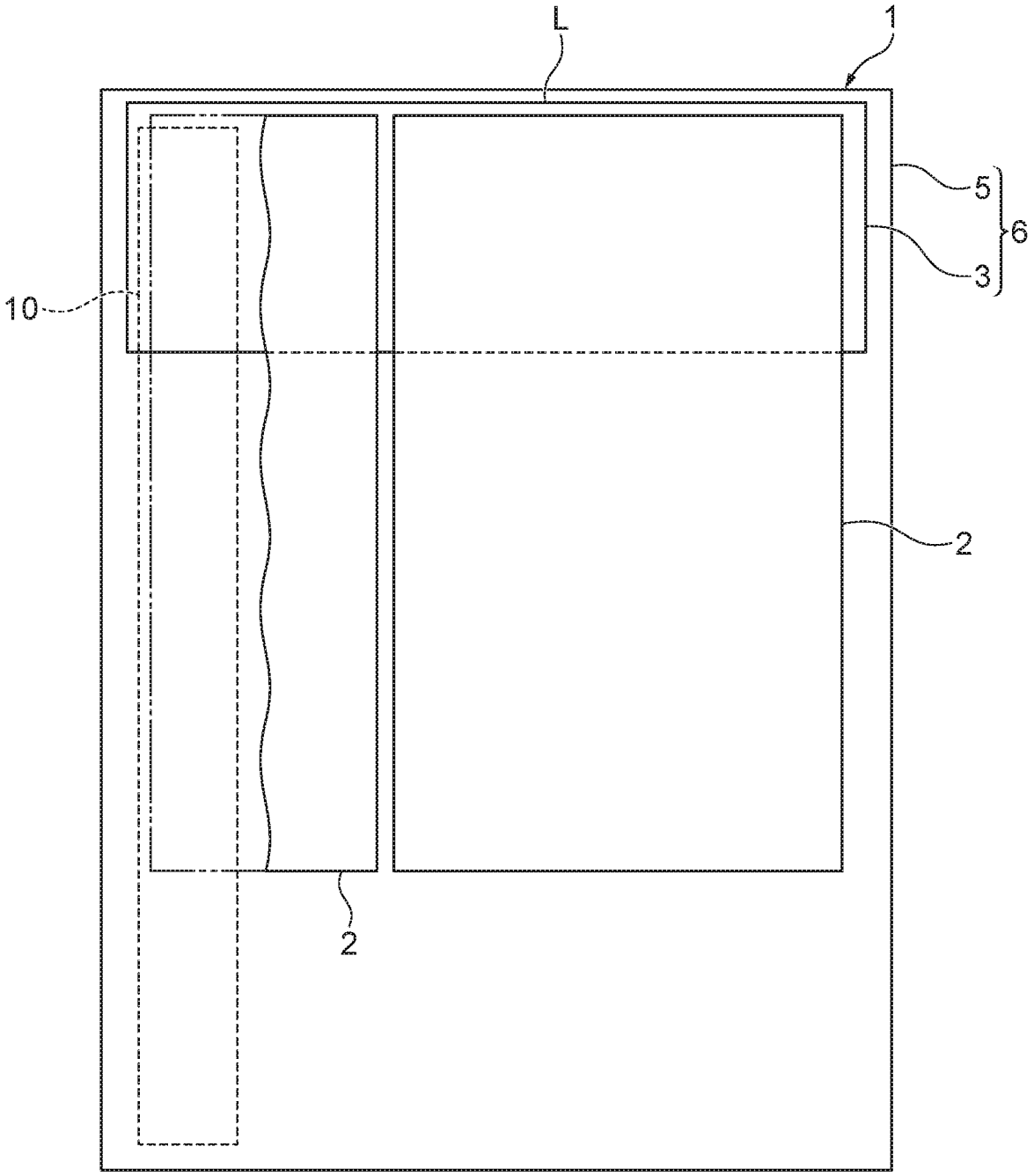
FIG. 8 is a plan view of an assembly according to a modified example.

FIG. 8 is a plan view of the assembly 1 according to a modified example. As illustrated in FIG. 8, the attachment adhesive part 10 is disposed on the reverse surface 5*b* of the fixing part 5, and may also be provided along a direction intersecting the folding line L of the support part 3 (for example, a direction orthogonal to the folding line L). Note that the support part 3 is disposed such that the folding line L extends along an outer edge of the fixing part 5.

In the assembly 1 described above, a configuration in which the laminate 2 is omitted, that is, a configuration in which the support part 3 is fixed to the fixing part 5 and the laminate 2 is not placed on the folding back part 32 of the support part 3 is a holder 6. That is, it can be described that the assembly 1 is formed by the laminate 2 and the holder 6 supporting the laminate 2.

Figure 10A:
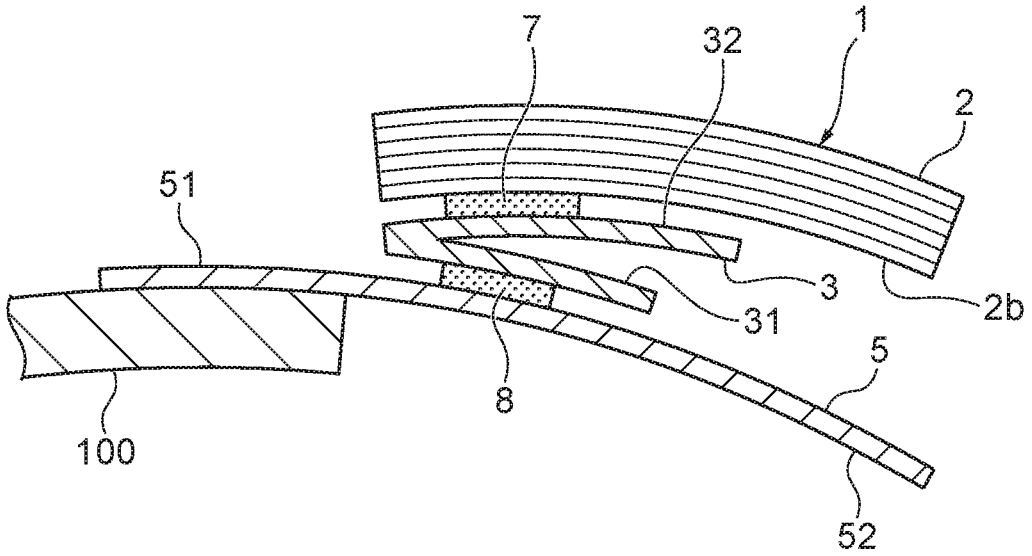
FIGS. 10A and 10B are views illustrating the assembly bent due to a bend of an adherend.
Figure 10B:
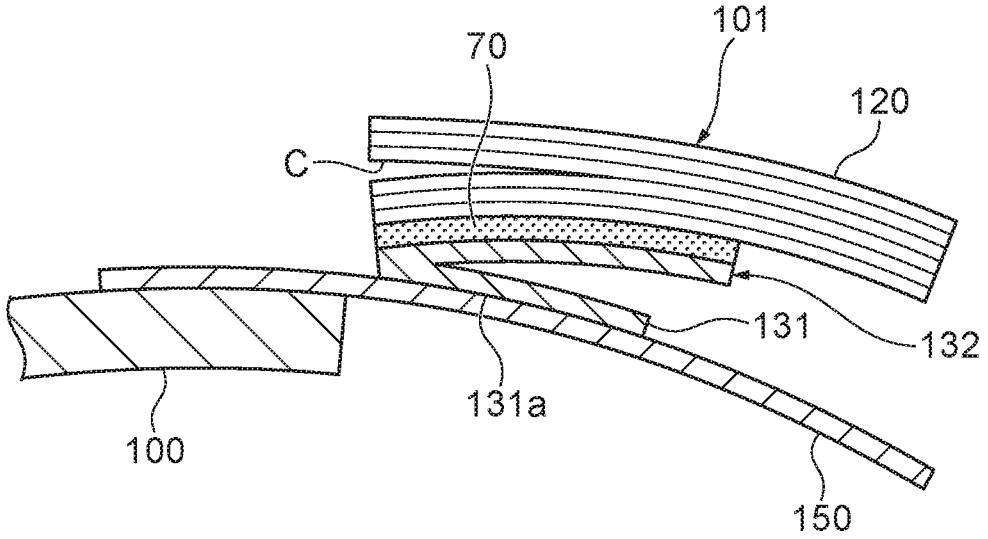

Next, an operation and effect of the assembly 1 according to the embodiment will be described with reference to FIGS. 9 and 10. As described above, one side surface of the assembly 1 according to the embodiment includes the laminate 2 and the support part 3 that supports the laminate 2, and the support part 3 includes the bottom surface part 31 and the folding back part 32 folded back from the bottom surface part 31. The reverse surface 2*b* of the laminate 2 protrudes from the folding back part 32, and a part of the reverse surface 2*b* is adhered to the folding back part 32 and thus supported by the support part 3. Further, the laminate adhesive part 7 that adheres a part of the reverse surface 2*b* and the support part 3 to each other is disposed in the overlapping region (first overlapping region AR1) of the reverse surface 2*b* and the folding back part 32 so as to be separated from at least a part of the peripheral edge E of the first overlapping region AR1.

For example, the assembly 1 is used by attaching the fixing part 5 to a notebook or the like (adherend 100). Note that, in a configuration in which the fixing part 5 is omitted, the assembly 1 may be used with the bottom surface part 31 of the support part 3 attached to the notebook or the like. When the user of the adherend 100 carries the adherend 100 or opens the adherend 100 with the assembly 1 attached, a load may be applied so as to bend the bottom surface part 31 of the support part 3. However, the bend is absorbed by an opening, as a buffer, between the bottom surface part 31 and the folding back part 32.

Further, the reverse surface 2*b* of the laminate 2 protrudes from the folding back part 32, and substantially only a part of the laminate 2 is supported by the folding back part 32. Therefore, even when the folding back part 32 is bent, the bending can hardly affect the laminate 2 compared to an aspect in which the entire reverse surface 2*b* of the laminate 2 is supported. Further, the laminate adhesive part 7 that adheres the folding back part 32 and the laminate 2 to each other is disposed in an overlapping region (first overlapping region AR1) of the folding back part 32 and the laminate 2 so as to be separated from at least a part of the peripheral edge E of the first overlapping region AR1. Further, in this separation region, a gap as a leeway is formed between the folding back part 32 and the laminate 2. This play absorbs the bend, and the laminate 2 is less likely to be affected. As described above, in this assembly 1, the effect of the bending of the adherend 100, such as a notebook, hardly appears in the laminate 2, and "cracking" or "peeling" does not easily occur in the laminate 2.

The "cracking" refers to a phenomenon in which a part (only a top part) of a tag lamination part is peeled off from a tag lamination part below the tag lamination part (a part closer to the folding back part 32) in the laminate 2 in which the tags 21 are laminated on each other. The "peeling" refers to a phenomenon in which a gap rather than "peeling" is unintentionally created between the tag lamination parts in the laminate 2 in which the tags 21 are laminated on each other, As the laminate is further used, peeling of the laminate becomes larger, and eventually cracking occurs in the laminate.

In contrast, in an assembly 101 according to a comparative embodiment (see FIG. 10B), the entire surface of a lower surface 131*a* of a bottom surface part 131 of a support part 130 is fixed to a fixing part 150. An adhesive part 70 that adheres a folding back part 132 and a laminate 120 is disposed on the entire surface of an overlapping region, and is not separated from a peripheral edge of the overlapping region. This reduces the number of elements that absorb the load due to the bending of the adherend 100, and requires the laminate 120 to bear the load, and thereby cracking C is likely to occur.

Further, the folding back part 32 of the assembly 1 according to this embodiment is folded back at the folding line L with respect to the bottom surface part 31, and the laminate adhesive part 7 is disposed so as to be separated from a part Ea, along the folding line L, of the peripheral edge E of the first overlapping region AR1 in the first separation direction Da. As a result, when a load is applied such that the assembly is bent to straddle the folding line L, the bend can be absorbed by the gap in the separation region.

The laminate adhesive part 7 according to this embodiment is disposed so as to be separated from the peripheral edge E of the first overlapping region AR1 in the second separation direction Db. As a result, when a load is applied such that the assembly is bent along the folding line L, the bend can be absorbed by the gap in the separation region.

The maximum width da of the laminate adhesive part 7 according to this embodiment in the first separation direction Da is equal to or greater than the separation distance dx of the first separation direction Da from the peripheral edge E of the first overlapping region AR1. As a result, the absorption of the bend in this separation region and the maintenance of the adhesion at the laminate adhesive part 7 can both be achieved.

The maximum width db of the laminate adhesive part 7 according to this embodiment in the second separation direction Db is equal to or greater than the separation distance dy of the second separation direction Db from the peripheral edge E of the first overlapping region AR1. As a result, the absorption of the bend in this separation region and the maintenance of the adhesion at the laminate adhesive part 7 can both be achieved.

Further, one aspect of the assembly 1 according to this embodiment includes the laminate 2, the support part 3 that supports the laminate 2, and the fixing part 5 that fixes the support part 3. The support part 3 includes the bottom surface part 31 and the folding back part 32 folded back from the bottom surface part 31. The reverse surface 2*b* of the laminate 2 protrudes from the folding back part 32, and a part of the reverse surface 2*b* is adhered to the folding back part 32 and thus supported by the support part 3. The support part 3 is fixed to the fixing part 5 by adhering the lower surface 31*b* of the bottom surface part 31 to the fixing part 5. The intermediate adhesive part 8 that adheres the bottom surface part 31 and the fixing part 5 to each other is disposed in the overlapping region (second overlapping region AR2) of the bottom surface part 31 and the fixing part 5, and is disposed so as to be separated from at least a part of the peripheral edge F of the second overlapping region AR2.

Further, one aspect of the holder 6 according to this embodiment includes the support part 3 that supports the laminate 2, and the fixing part 5 that fixes the support part 3. The support part 3 includes the bottom surface part 31 and the folding back part 32 that is folded back from the bottom surface part 31. The support part 3 is fixed to the fixing part 5 by adhering the lower surface 31*b* of the bottom surface part 31 and the fixing part 5 to each other. The intermediate adhesive part 8 that adheres the bottom surface part 31 and the fixing part 5 to each other is disposed in the overlapping region (second overlapping region AR2) of the bottom surface part 31 and the fixing part 5, and is disposed so as to be separated from at least a part of the peripheral edge F of the second overlapping region AR2.

In the separation region where the intermediate adhesive part 8 is separated from the peripheral edge F of the second overlapping region AR2, a gap as a leeway is created between the bottom surface part 31 and the fixing part 5. This play absorbs the bend, and the laminate 2 is less likely to be affected. As a result, in the assembly 1, the effect of the bending of the adherend 100 (the notebook or the like) hardly appears in the laminate 2, and "cracking" or "peeling" does not easily occur in the laminate 2. Therefore, in the assembly 1 and the holder 6 described above, cracking of the laminate 2 can be effectively suppressed.

In addition, the intermediate adhesive part 8 according to this embodiment is disposed so as to be separated from the part Fa, along the folding line L, of the peripheral edge F of the second overlapping region AR2 in the first separation direction Da. When a load is applied such that the assembly is bent along the folding line L, the bend can be absorbed by the gap in the separation region.

In addition, the intermediate adhesive part 8 according to this embodiment is disposed so as to be separated from the peripheral edge F of the second overlapping region AR2 in the second separation direction Db. When a load is applied such that the assembly is bent along the folding line L, the bend can be absorbed by the gap in the separation region.

The maximum width dc of the intermediate adhesive part 8 according to this embodiment in the first separation direction Da is equal to or greater than the separation distance ds of the first separation direction Da from the peripheral edge E of the first overlapping region AR1. As a result, the absorption of the bend in this separation region and the maintenance of the adhesion at the intermediate adhesive part 8 can both be achieved.

The maximum width de of the intermediate adhesive part 8 according to this embodiment in the second separation direction Db is equal to or greater than the separation distance dt of the second separation direction Db from the peripheral edge E of the first overlapping region AR1. As a result, the absorption of the bend in this separation region and the maintenance of the adhesion at the intermediate adhesive part 8 can both be achieved.

Further, the fixing part 5 of the assembly 1 according to this embodiment includes the attachment adhesive part 10, and the mounting adhesive part 10 is provided along the extension direction of the folding line L of the support part 3. As a result, even when a load is applied such that the assembly is bent to straddle the folding line L, the fixing part 5 is stably held in place by the attachment adhesive part 10.

Further, in the above-described modified example, the fixing part 5 of the assembly 1 includes the attachment adhesive part 10, and the attachment adhesive part 10 is provided along a direction intersecting the folding line L of the support part 3. As a result, even when a load is applied such that the assembly is bent so as to straddle the folding line L, the fixing part 5 is stably held in place by the attachment adhesive part 10.

EXAMPLES

Hereinafter, the present invention will be described more specifically with reference to examples. However, the present invention is not limited to the examples. First, common elements of the examples and the comparative example will be described. A substantially rectangular paper card with a corner bent in plan view was used as the fixing part. The long side of the fixing part was 108 mm and the short side of the fixing part was 85 mm. In addition, a substantially rectangular paper card with a corner bent in plan view was used as the support part. In the expanded state before the folding back part was folded back, the long side was 79 mm and the short side was 55 mm. The support part folded back on the card in the expanded state to form the bottom surface part and the folding back part. The folding line was formed so as to be substantially parallel to the long side of the card in the expanded state. The length (width) of the bottom surface part in the direction orthogonal to the folding line was 25 mm, and the length (width) of the folding back part in the direction orthogonal to the folding line was 30 mm.

The bottom surface part of the supporting part was placed on the fixing part, and fixed with an adhesive. The support part was disposed such that the folding line was substantially parallel to the short side of the fixing part, and was further disposed in the center in the direction along the short side of the fixing part. Next, a plurality of laminates in which a plurality of tags was laminated was prepared, and arranged at equal intervals in the longitudinal direction of the folding back parts (the direction along the folding line). The reverse surfaces of the laminates were fixed to the top surface of the folding back part by an adhesive.

Hereinafter, the examples and the comparative examples will be described. In the following Examples 1 to 16 and Comparative Examples 1 and 2, the laminates were bent along the longitudinal direction (vertical direction) of the tags and left in this state for three days, after which cracking and peeling were evaluated. A plurality of identical structures was prepared for each of the examples and comparative examples, and the presence or absence of cracking or peeling was studied. Note that, in the comparative examples, a ratio of occurrence of cracking was 100%.

Example 1

As the tags to form the laminate, a high-adhesive post-it (registered trademark) high adhesive note (manufactured by 3M) was used. The length of the short side of the tag was 13 mm and the length of the long side of the tag was 50 mm. The laminate adhesive part (first adhesive part) was disposed in a substantially rectangular shape along the longitudinal direction of the tags. The separation distance of the laminate adhesive part from the first overlapping region in the first separation direction was 5 mm. The maximum width of the laminate adhesive part in the first separation direction was 10 mm. The separation distance from the first overlapping region in the second separation direction of the laminate adhesive part was 5 mm (2.5 mm on each side and a total of 5 mm on the left and right). Further, the separation distance of the intermediate adhesive part from the second overlapping region in the first separation direction was 10 mm, and the separation distance of the intermediate adhesive part from the second overlapping region in the second separation direction was 0 mm.

Example 2

The separation distance of the laminate adhesive part from the first overlapping region in the first separation direction was 10 mm, and the rest was the same as in Example 1.

Example 3

As the tags for forming the laminate, a normal-adhesive post-it (registered trademark) note (manufactured by 3M) was used. The length of the short side of the tag was 13 mm, and the length of the long side of the tag was 50 mm. The rest was the same as in Example 1.

Example 4

As the tags for forming the laminate, the normal-adhesive post-it (registered trademark) note (manufactured by 3M)), which was used in Example 3, was used. The rest was the same as in Example 2.

Example 5

The separation distance of the laminate adhesive part from the first overlapping region in the second separation direction was 0 mm. The rest was the same as in Example 2.

Comparative Example 1

As the tags forming the laminate, a high-adhesive post-it (registered trademark) high adhesive note (manufactured by 3M) was used. The separation distances from the first overlapping region in the first separation direction and the second separation direction of the laminate adhesive part were 0 mm. In addition, the separation distance from the second overlapping region to the intermediate adhesive part in the first separation direction was 0 mm. The rest was the same as in Example 1.

TABLE 1

| | | Laminate adhesive part | | Intermediate adhesive part | | | |
|---|---|---|---|---|---|---|---|
| | Adhesive type | First separation distance | Second separation distance | First separation distance | Second separation distance | Number of measurements | Ratio of occurrence of cracking |
| Example 1 | High adhesive | 5 mm | 5 mm | 10 mm | 0 mm | 10 | 20% |
| Example 2 | High adhesive | 10 mm | 5 mm | 10 mm | 0 mm | 15 | 0% |
| Example 3 | Normal adhesive | 5 mm | 5 mm | 10 mm | 0 mm | 10 | 0% |
| Example 4 | Normal adhesive | 10 mm | 5 mm | 10 mm | 0 mm | 15 | 0% |
| Example 5 | High adhesive | 10 mm | 0 mm | 10 mm | 0 mm | 15 | 0% |
| Comparative Example 1 | High adhesive | 0 mm | 0 mm | 0 mm | 0 mm | 10 | 100% |

As shown in Table 1, according to Examples 1 to 5, the ratio of occurrence of at least cracking was 20% or less, and in particular, cracking was not confirmed according to Examples 2 to 5. On the other hand, in Comparative Example 1, the ratio of occurrence of cracking was 100%.

Example 6

The length of the folding back part in the first separation direction was 15 mm. The length of the bottom part was kept at 25 mm, and the rest was the same as in Example 2.

Example 7

The length of the folding back part in the first separation direction was 30 mm. The rest was the same as in Example 6.

Example 8

The length of the folding back part in the first separation direction was 60 mm. The rest was the same as in Example 6.

Example 9

The length of the folding back part in the first separation direction was 15 mm. The length of the bottom side was kept at 25 mm, and the rest was the same as in Example 4.

Example 10

The length of the folding back part in the first separation direction was 30 mm. The rest was the same as in Example 9.

Example 11

The length of the folding back part in the first separation direction was 60 mm. The rest was the same as in Example 9.

TABLE 2

| | Adhesive type | Length of folding back part | Number of measure-ments | Ratio of occurrence of cracking |
|---|---|---|---|---|
| Example 6 | High adhesive | 15 mm | 15 | 13% |
| Example 7 | High adhesive | 30 mm | 15 | 0% |
| Example 8 | High adhesive | 60 mm | 15 | 0% |
| Example 9 | Normal adhesive | 15 mm | 10 | 0% |
| Example 10 | Normal adhesive | 30 mm | 15 | 0% |
| Example 11 | Normal adhesive | 60 mm | 5 | 0% |

As shown in Table 2, no cracking was observed in Examples 7 to 11. In addition, although cracking was confirmed in Example 6, the ratio of occurrence of cracking was 13%.

Figure 11A:
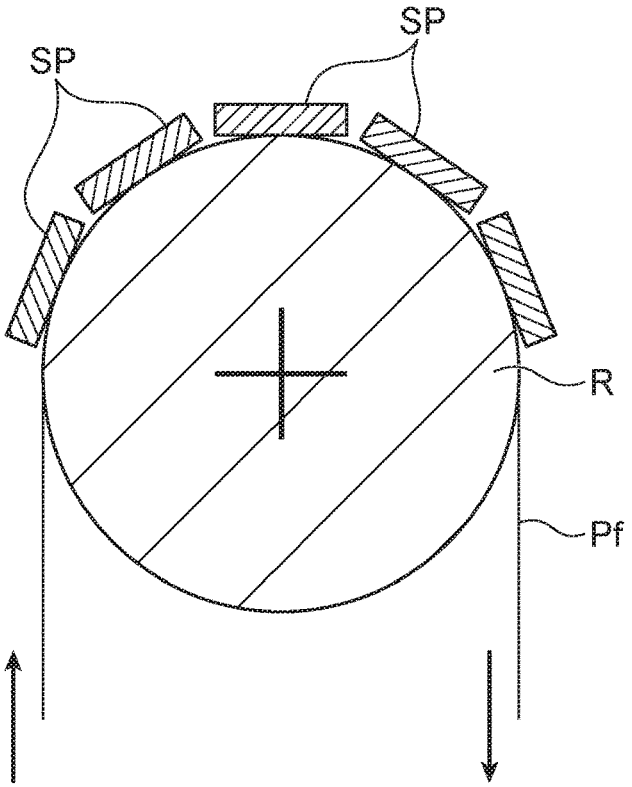
FIG. 11A is an explanatory diagram illustrating the assembly according to an example and a comparative example that is loaded so as to be bent along a folding line of a support part.
Figure 11B:
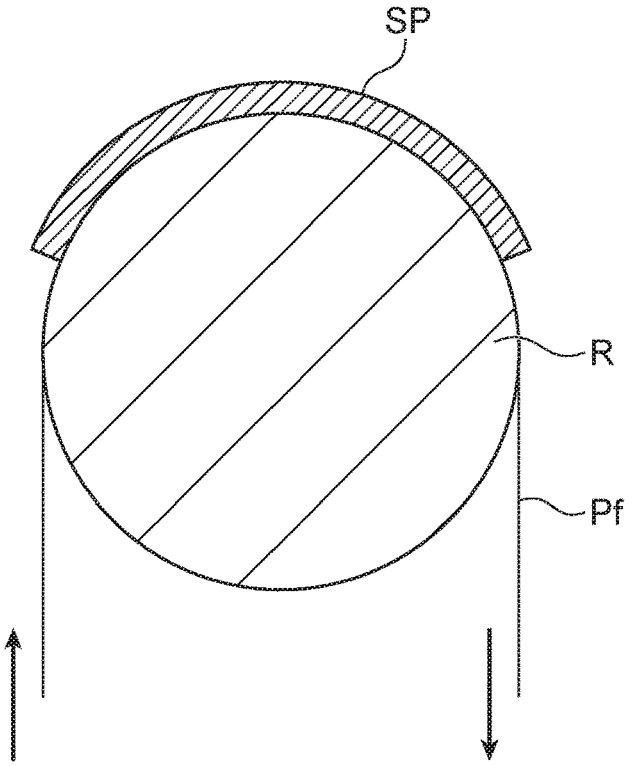
FIG. 11B is an explanatory diagram illustrating an assembly according to an example and a comparative example is loaded so as be to bent to straddle the folding line of the support part.

Next, experimental results different from the evaluation described above will be described. FIGS. 11A and 11B are explanatory diagrams schematically illustrating this experiment. FIG. 11A illustrates an experiment for evaluating a state in which the tags are bent in a direction orthogonal to the longitudinal direction (vertical direction) of the tags (lateral direction). FIG. 11B illustrates an experiment for evaluating a state in which the tags are bent in the vertical direction of the tags. First, a PET (polyethylene terephthalate) film Pf is prepared on which a sample SP according to each of the examples and the like to be described below is placed. This PET film Pf was placed along a circumferential surface of a roll R and rolled back and forth approximately 50 times. When the sample SP was bent in the lateral direction (FIG. 11A), the sample SP was affixed to the PET film Pf such that the laminate of the sample SP was disposed along the axial direction of roll R. Further, when the sample SP was bent in a vertical manner (FIG. 11B), the sample SP was affixed to the PET film Pf such that the laminate of sample SP was disposed along the circumferential direction of the roll R.

Example 12

Figure 12A:
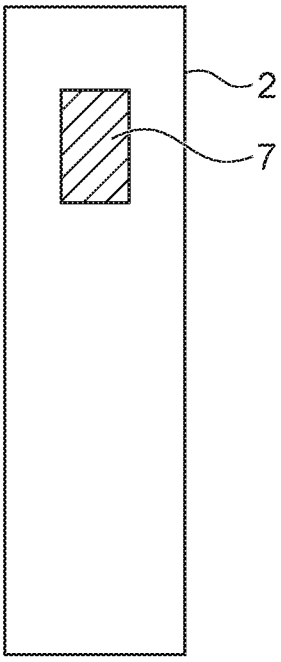
FIGS. 12A to 12D are diagrams each describing an experiment in which the assembly is bent.

As the tags forming the laminate, a high-adhesive post-it (registered trademark) high adhesive note (manufactured by 3M) was used. The intermediate adhesive part was separated from the peripheral edge of the second overlapping region in the first separation direction by 0 mm. This separation distance is referred to as the first separation distance of the intermediate adhesive part for convenience. On the other hand, the separation distance from the peripheral edge of the first overlapping region to the laminate adhesive part 7 (see FIG. 12A) in the first separation direction was 10 mm. This separation distance is referred to as the first separation distance of the laminate adhesive part for convenience. Further, the separation distance from the peripheral edge of the second overlapping region in the second separation direction to the laminate adhesive part was 8 mm (4 mm on each side and a total of 8 mm on the left and right). This separation direction is referred to as the second separation direction of the laminate bond for convenience.

Example 13

Figure 12B:
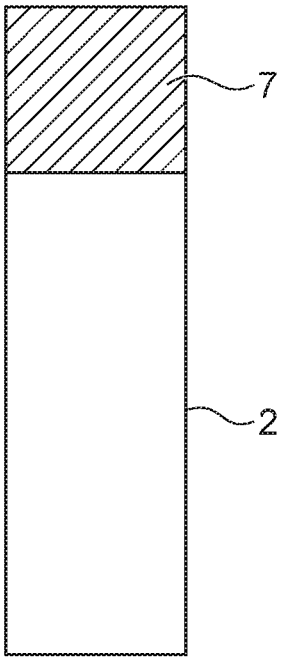

The first separation distance of the intermediate adhesive part was 10 mm. On the other hand, the laminate adhesive part 7 (see FIG. 12B) was disposed without a gap across the entire first overlapping region. That is, the first separation distance and the second separation distance of the laminate adhesive part were 0 mm. The rest was same as in Example 12.

Example 14

The first separation distance of the intermediate adhesive part was 10 mm. The rest was substantially the same as in Example 12 (see FIG. 12A).

Example 15

Figure 12C:
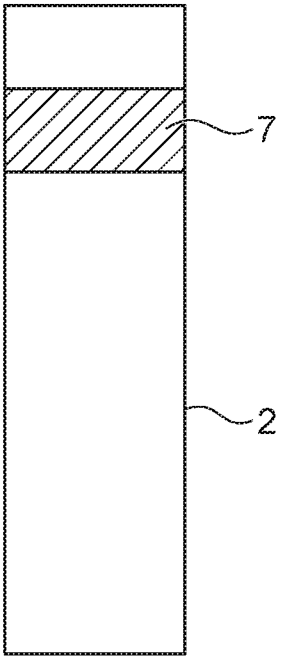

The first separation distance of the laminate adhesive part was 10 mm. The rest was the same as in Example 13 (see FIG. 12C).

Example 16

Figure 12D:
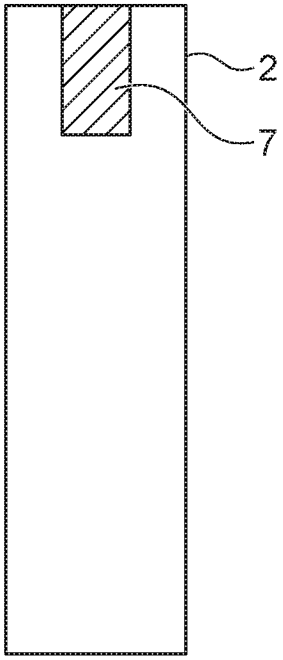

The first separation distance of the laminate adhesive part was 0 mm. The rest was the same as in Example 14 (see FIG. 12D).

Comparative Example 2

The first separation distance and the second separation distance of the laminate adhesive part were 0 mm. The first separation distance of the intermediate adhesive part was 0 mm.

TABLE 3

| | Laminate adhesive part | | Intermediate adhesive part | | Number of measurements | Number of occurrences of cracking | Number of occurrences of peeling | |
|---|---|---|---|---|---|---|---|---|
| | First separation distance | Second separation distance | First separation distance | Bend direction | (number of measured laminates) | (number of laminates with cracking) | (number of laminates with peeling) | Evaluation |
| Example 12 | 10 mm | 8 mm | 0 mm | Longitudinal direction | 5 | 5 | — | A2 |
| | | | | Lateral direction | 5 | 0 | 0 | |

TABLE 3-continued

| | Laminate adhesive part | | Intermediate adhesive part | | Number of measurements | Number of occurrences of cracking | Number of occurrences of peeling | |
|---|---|---|---|---|---|---|---|---|
| | First separation distance | Second separation distance | First separation distance | Bend direction | (number of measured laminates) | (number of laminates with cracking) | (number of laminates with peeling) | Evaluation |
| Example 13 | 0 mm | 0 mm | 10 mm | Longitudinal direction | 5 | 0 | 5 | A1 |
| | | | | Lateral direction | 5 | 0 | 3 | |
| Example 14 | 10 mm | 8 mm | 10 mm | Longitudinal direction | 5 | 0 | 0 | S |
| | | | | Lateral direction | 5 | 0 | 0 | |
| Example 15 | 10 mm | 0 mm | 10 mm | Longitudinal direction | 5 | 0 | 2 | A1 |
| | | | | Lateral direction | 5 | 0 | 4 | |
| Example 16 | 0 mm | 8 mm | 10 mm | Longitudinal direction | 5 | 0 | 3 | A1 |
| | | | | Lateral direction | 5 | 0 | 1 | |
| Comparative Example 2 | 0 mm | 0 mm | 0 mm | Longitudinal direction | 5 | 5 | — | B |
| | | | | Lateral direction | 5 | 1 | 3 | |

As shown in Table 3, Example 14 has the first separation distance and the second separation distance of the laminate adhesive part and a first separation distance of the intermediate adhesive part. In Example 14, "cracking" did not occur in both bends in the longitudinal direction and the lateral direction. Further, in Example 14, no "peeling" as a stage before advancing to "cracking" occurred. That is, in Example 14, both "cracking" and "peeling" were suppressed and the best evaluation "S" was given.

As shown in Table 3, in Examples 13, 15, and 16, "cracking" did not occur in both bends in the longitudinal direction and the lateral direction. On the other hand, in Examples 13, 15, and 16, although "cracking" did not occur, "peeling" occurred. Therefore, an evaluation "A1" was given. Examples 13, 15, and 16 are hereinafter referred to as "A1 examples" for convenience.

As shown in Table 3, Example 12 has a first separation distance and a second separation distance of the laminate adhesive part, but do not have a first separation distance of the intermediate adhesive part. Further, in Example 12, cracking occurred in the bend in the longitudinal direction, but no cracking or peeling occurred for the bend in the lateral direction. Therefore, Example 12 was evaluated as "A2". Hereinafter, Example 12 is referred to as "A2 example" for convenience.

As shown in Table 3, Comparative Example 2 does not have a first separation distance of the laminate adhesive part, a second separation distance, and a first separation distance of the intermediate adhesive part. In Comparative Example 2, cracking occurred in the vertical direction as well as when bent in the lateral direction. Further, peeling occurred in three out of four cases where no cracking occurred when bent in the lateral direction. Therefore, Comparative Example 2 was evaluated as "B".

Here, in comparison of the A1 examples and A2 example, at least A1 examples have a first separation distance of the intermediate adhesive part, whereas A2 example do not have a first separation distance of the intermediate adhesive part. Then, in the A2 example, cracking occurred for the bend in the longitudinal direction, whereas, in the A1 examples, cracking not only for the bend in the lateral direction but also for the bend in the longitudinal direction is suppressed. In other words, the first separation distance of the intermediate adhesive part is advantageous in terms of prevention of cracking in multiple directions such as the longitudinal direction and the lateral direction.

Next, Examples 13, 15, and 16 as A1 examples are compared. Here, Example 13 has a first separation distance of the intermediate adhesive part, Example 15 has a first separation distance of the laminate adhesive part and a first separation distance of the intermediate adhesive part, and Example 16 has a second separation distance of the laminate adhesive part and a first separation distance of the intermediate adhesive part. Further, in terms of suppression of peeling, the effect is reduced in the order of Example 16, Example 15, and Example 13. In other words, the separation distance of the laminate adhesive part is advantageous in terms of suppression of peeling.

Next, Examples 15 and 16 are compared. Example 15, which has a first separation distance of the laminate adhesive part, has two cases of peeling for the bend in the longitudinal direction, and four cases of peeling for the bend in the lateral direction. That is, it can be said that the first separation distance of the laminate adhesive part is advantageous for the bend in the longitudinal direction. Further, Example 16, which has the second separation distance of the laminate adhesive part, has three cases of peeling for the bend in the longitudinal direction, and one case of peeling for the bend in the lateral direction. That is, it can be said that the second separation direction of the laminate adhesive part is advantageous for the bend in the lateral direction.

Next, compared to the A2 example and Comparative Example 2, at least A2 example has the first separation distance and the second separation distance of the laminate adhesive part, whereas Comparative Example 2 does not have the separation distance of the laminate adhesive part. Further, according to Comparative Example 2, cracking occurred for the bend in the lateral direction, and three cases of peeling occurred among four cases in which at least no cracking occurred. In contrast, no peeling occurred in the A2 example. That is, the separation distance of the laminate adhesive part is advantageous in terms of suppression of peeling.

REFERENCE SIGNS LIST

1 . . . Assembly, 2 . . . Laminate, 2*a* . . . Surface of laminate, 2*b* . . . Reverse surface of laminate, 21 . . .

Tag, 3 . . . Support part, 31 . . . Bottom surface part, 31*b* . . . Lower surface, 32 . . . Folding back part, 5 . . . Fixing part, 6 . . . Holder, 7 . . . Laminate adhesive part (first adhesive part), 8 . . . Intermediate adhesive part, Dx . . . Lamination direction, L . . . Folding line, AR1 . . . First overlapping region, E . . . Peripheral edge of first overlapping region, Ea . . . Part, along the folding line, of peripheral edge of first overlapping region, Da . . . Direction orthogonal to folding line, Db . . . Extension direction of folding line, da . . . Maximum width of laminate adhesive part in first separation direction, db . . . Maximum width of laminate adhesive part in second separation direction, AR2 . . . Second overlapping region, F . . . Peripheral edge of second overlapping region, FA . . . Part along folding line in peripheral edge of second overlapping region, dc . . . Maximum width in first separation direction, de . . . Maximum width of intermediate adhesive part in second separation direction.

The invention claimed is:

1. An assembly comprising:

a laminate in which at least a plurality of tags are laminated; and a support part that supports the laminate, wherein the plurality of tags are releasably adhered to each other, the support part includes a bottom surface part and a folding back part folded back from the bottom surface part, the laminate includes a surface on a first side and a reverse surface on a second side in a lamination direction of the plurality of tags, the reverse surface protruding from the folding back part and having a part being adhered to the folding back part to be supported by the support part, and a first adhesive part to which the part of the reverse surface and the support part are adhered is disposed in an overlapping region of the reverse surface and the folding back part so as to be separated from at least part of a peripheral edge of the overlapping region, wherein the folding back part is folded back at a folding line with respect to the bottom surface part; and the first adhesive part is disposed so as to be separated from at least one side part of the peripheral edge of the overlapping region in an extension direction of the folding line, separated from any part of the peripheral edge of the overlapping region in a direction orthogonal to the folding line, or both.

2. The assembly according to claim 1, the first adhesive part is disposed so as to be separated from any part, along the folding line, of the peripheral edge of the overlapping region in the direction orthogonal to the folding line.

3. The assembly according to claim 2, wherein a maximum width of the first adhesive part in a separation direction from the peripheral edge of the overlapping region is equal to or greater than a separation distance from the peripheral edge of the overlapping region.

4. An assembly comprising:

a laminate in which at least a plurality of tags are laminated;

a support part that supports the laminate; and a fixing part that fixes the support part, wherein the plurality of tags are releasably adhered to each other, the support part includes a bottom surface part and a folding back part that is folded back from the bottom surface part, the laminate includes a surface on a first side and a reverse surface on a second side in a lamination direction of the plurality of tags, the reverse surface protruding from the folding back part and having a part being adhered to the folding back part to be supported by the support part, the support part is fixed to the fixing part by adhering, to the fixing part, a surface of the bottom surface part opposite to a surface facing the folding back part, and a second adhesive part to which the bottom surface part and the fixing part are adhered is disposed in an overlapping region of the bottom surface part and the fixing part so as to be separated from at least a part of a peripheral edge of the overlapping region, wherein the folding back part is folded back at a folding line with respect to the bottom surface part, and the fixing part includes a third adhesive part on a surface opposite to a surface to which the bottom surface part is adhered, and the third adhesive part is provided along an extension direction of the folding line, along a direction intersecting the folding line, or both.

5. The assembly according to claim 4, wherein the folding back part is folded back at a folding line with respect to the bottom surface part, and the second adhesive part is disposed so as to be separated from at least part, along the folding line, of the peripheral edge of the overlapping region in a direction orthogonal to the folding line.

6. The assembly according to claim 5, wherein a maximum width of the second adhesive part in a separation direction from the peripheral edge of the overlapping region is equal to or greater than a separation distance from the peripheral edge of the overlapping region.

7. The assembly according to claim 4, wherein the folding back part is folded back at a folding line with respect to the bottom surface part, and the second adhesive part is disposed so as to be separated from the peripheral edge of the overlapping region in an extension direction of the folding line.

8. The assembly according to claim 4, wherein a first adhesive part to which the part of the reverse surface and the support part are adhered is disposed in an overlapping region of the reverse surface and the folding back part so as to be separated from at least a part of the peripheral edge of the overlapping region.

9. The assembly according to claim 4, wherein the third adhesive part is provided along the extension direction of the folding line.

10. The assembly according to claim 4, wherein the third adhesive part is provided along the direction intersecting the folding line.

11. A holder for a laminate in which at least a plurality of tags are laminated, the holder comprising:

a support part that supports the laminate; and a fixing part that fixes the support part, wherein the support part includes a bottom surface part and a folding back part folded back from the bottom surface part, the folding back part being provided with a laminate support region, the support part is fixed to the fixing part by adhering the fixing part and a surface of the bottom surface part opposite to a surface facing the folding back part to each other, and an adhesive part to which the bottom surface part and the fixing part are adhered is disposed in an overlapping region of the bottom surface part and the fixing part so as to be separated from at least a part of a peripheral edge of the overlapping region, wherein the folding back part is folded back at a folding line with respect to the bottom surface part, and the fixing part includes a third adhesive part on a surface opposite to a surface to which the bottom surface part is adhered, and the third adhesive part is provided along an extension direction of the folding line, along a direction intersecting the folding line, or both.

* * * * *